US010767392B2

(12) United States Patent
Aguirrezabala Olasagasti

(10) Patent No.: US 10,767,392 B2
(45) Date of Patent: Sep. 8, 2020

(54) LOCK WITH IMPROVED LOCKING SYSTEM

(71) Applicant: Ojmar, S.A., Elgoibar (ES)

(72) Inventor: Joseba Jokin Aguirrezabala Olasagasti, Elgoibar (ES)

(73) Assignee: Ojmar, S.A., Elgoibar (Guipuzcoa) (ES)

( * ) Notice: Subject to any disclaimer, the term of this patent is extended or adjusted under 35 U.S.C. 154(b) by 317 days.

(21) Appl. No.: 15/514,042

(22) PCT Filed: Sep. 23, 2015

(86) PCT No.: PCT/ES2015/070689
§ 371 (c)(1),
(2) Date: Mar. 24, 2017

(87) PCT Pub. No.: WO2016/046440
PCT Pub. Date: Mar. 31, 2016

(65) Prior Publication Data

US 2017/0275923 A1 Sep. 28, 2017

(30) Foreign Application Priority Data

Sep. 26, 2014 (ES) ..... 201431410

(51) Int. Cl.
*E05B 63/00* (2006.01)
*E05B 9/08* (2006.01)
(Continued)

(52) U.S. Cl.
CPC ..... *E05B 63/006* (2013.01); *E05B 9/08* (2013.01); *E05B 65/025* (2013.01); *E05B 9/00* (2013.01);
(Continued)

(58) Field of Classification Search
CPC ..... E05B 63/006; E05B 9/08; E05B 65/025; E05B 15/001; E05B 37/00;
(Continued)

(56) References Cited

U.S. PATENT DOCUMENTS 1,241,754 A 10/1917 Molden
2,178,132 A * 10/1939 Anderson ..... E05B 9/00 70/450
(Continued)

FOREIGN PATENT DOCUMENTS

DE 3233580 A1 3/1984
GB 2075586 A 11/1981
(Continued)

*Primary Examiner* — Kristina R Fulton
*Assistant Examiner* — Faria F Ahmad
(74) *Attorney, Agent, or Firm* — The Webb Law Firm

(57) ABSTRACT

The invention relates to a lock with an improved locking system, including a lock block attached to a support by means of at least two fastening screws, with a door arranged between the lock block and the support, the lock including grub screws screwed into the support, which project from the support by a length according to the portion of grub screw screwed into the support, such that the length matches a clearance between the door and the support.

11 Claims, 3 Drawing Sheets

(51) Int. Cl.

| | |
|---|---|
| ***E05B 65/02*** | (2006.01) |
| ***E05B 65/44*** | (2006.01) |
| ***E05B 9/00*** | (2006.01) |
| ***E05B 15/00*** | (2006.01) |
| ***E05B 9/04*** | (2006.01) |
| ***E05B 9/02*** | (2006.01) |
| ***E05B 37/00*** | (2006.01) |

(52) U.S. Cl.
CPC ..... *E05B 9/002* (2013.01); *E05B 9/02* (2013.01); *E05B 9/045* (2013.01); *E05B 15/00* (2013.01); *E05B 37/00* (2013.01); *E05B 65/44* (2013.01); *Y10S 292/53* (2013.01); *Y10S 292/54* (2013.01); *Y10T 292/62* (2015.04)

(58) Field of Classification Search
CPC ..... E05B 63/0056; E05B 9/00; E05B 9/002; E05B 9/02; E05B 9/045; E05B 65/44; Y10T 70/7706; Y10T 70/8541; Y10T 70/7655; Y10T 292/54
USPC ..... 292/DIG. 53, DIG. 54
See application file for complete search history.

(56) References Cited

U.S. PATENT DOCUMENTS 2,413,732 A * 1/1947 Schlage ..... E05B 9/00 292/337
2,952,150 A * 9/1960 Matzkin ..... E05B 65/0025 292/337
3,000,659 A * 9/1961 Schlage ..... E05C 1/163 292/336.3
3,503,233 A 3/1970 Russell et al.
3,513,674 A * 5/1970 Rutherford ..... E05B 9/00 292/337
3,899,907 A 8/1975 Prahl
4,074,552 A * 2/1978 Smith ..... E05B 17/2084 70/417
4,186,954 A * 2/1980 Detlefs ..... E05B 15/0205 292/340
4,272,974 A * 6/1981 Hennessy ..... E05B 63/0017 70/129
4,456,290 A * 6/1984 Gross ..... E05B 65/0025 292/337
4,489,577 A * 12/1984 Crepinsek ..... E05B 15/02 403/348
4,573,334 A 3/1986 Crepinsek
4,688,409 A * 8/1987 Oliver ..... E05B 15/1614 70/417
4,708,007 A 11/1987 Stoia
4,782,677 A * 11/1988 O'Gara ..... E05B 9/08 70/417
4,875,726 A * 10/1989 Thau ..... E05B 79/06 292/337
4,887,856 A * 12/1989 Percoco ..... E05B 9/08 292/337
5,267,461 A * 12/1993 Eizen ..... E05B 15/1614 70/417
5,473,922 A * 12/1995 Bair ..... E05B 47/0012 292/144
5,657,652 A * 8/1997 Martin ..... E05B 55/12 70/85
5,678,437 A 10/1997 Walla
5,746,457 A * 5/1998 Kim ..... E05B 79/04 292/216
5,762,387 A * 6/1998 Edgerly ..... E05B 3/06 292/347
5,787,741 A * 8/1998 Shen ..... E05B 15/02 292/21
5,816,083 A * 10/1998 Bianco ..... E05B 17/0058 70/278.3
5,881,585 A * 3/1999 Kang ..... E05B 59/00 292/21
5,893,282 A * 4/1999 Runge ..... E05B 63/0056 70/208
5,950,467 A * 9/1999 Dong ..... E05B 63/10 292/150
5,984,383 A * 11/1999 Parikh ..... E05B 1/0092 292/121
6,058,746 A * 5/2000 Mirshafiee ..... E05B 63/0056 292/39
6,178,795 B1 * 1/2001 Hsueh ..... E05B 13/005 292/172
6,361,088 B1 * 3/2002 Ramsauer ..... E05B 9/08 292/202
6,691,538 B1 * 2/2004 Yang ..... E05B 13/002 292/347
6,722,170 B2 * 4/2004 Squier ..... E05B 9/08 292/DIG. 53
7,363,789 B2 * 4/2008 Squier ..... E05B 9/08 292/DIG. 53
D788,568 S * 6/2017 Karnani ..... D8/330
10,161,162 B2 * 12/2018 Schaeffer ..... E05B 15/02
2003/0010073 A1 * 1/2003 Larsen ..... E05B 35/10 70/208
2003/0084616 A1 * 5/2003 Kimball ..... E05B 9/02 49/504
2003/0145638 A1 * 8/2003 Su ..... E05B 15/02 70/417
2004/0040356 A1 * 3/2004 Su ..... E05B 9/082 70/370
2005/0262906 A1 * 12/2005 Romero ..... E05B 9/02 70/107
2006/0282987 A1 * 12/2006 Shih ..... B60Q 1/2669 16/412
2007/0240465 A1 * 10/2007 Clifford ..... E05B 9/02 70/370
2009/0071204 A1 * 3/2009 Garza ..... E05B 63/0017 70/107
2010/0031713 A1 * 2/2010 Brown ..... E05B 47/00 70/91
2011/0314878 A1 * 12/2011 Roth ..... E05B 47/02 70/107
2012/0324970 A1 * 12/2012 Watanabe ..... E05B 37/16 70/315
2013/0000364 A1 * 1/2013 Huang ..... E05B 17/2084 70/107
2013/0004260 A1 * 1/2013 Hesselback ..... E05B 9/08 411/366.1
2013/0076046 A1 * 3/2013 Shah ..... E05B 63/0056 292/336.3
2014/0053678 A1 * 2/2014 Gottschling ..... E05B 1/0092 74/523
2014/0165669 A1 * 6/2014 Tien ..... E05B 53/00 70/91
2014/0165678 A1 * 6/2014 Burrus ..... E05B 37/00 70/279.1
2014/0216112 A1 8/2014 Yang
2014/0216810 A1 * 8/2014 Blumenthal ..... E05B 85/02 174/535
2015/0076845 A1 * 3/2015 Ou ..... E05B 63/006 292/358
2015/0167354 A1 * 6/2015 Tien ..... E05B 41/00 292/92
2015/0176306 A1 * 6/2015 Lai ..... E05B 65/5207 70/344
2015/0191932 A1 * 7/2015 Bicic ..... D06F 39/14 70/451
2016/0097218 A1 * 4/2016 Tien ..... E05B 3/00 70/57
2016/0115709 A1 * 4/2016 Jeong ..... E05B 9/08 16/402
2016/0194899 A1 * 7/2016 Aykas ..... E05B 15/024 292/341.15
2016/0340930 A1 * 11/2016 Schaeffer ..... E05B 15/02
2017/0114570 A1 * 4/2017 Hallett ..... E05B 47/00
2017/0218666 A1 * 8/2017 Lane ..... E05B 63/006
2017/0275917 A1 * 9/2017 Murphy ..... E05B 3/04
2018/0016812 A1 * 1/2018 Sanford ..... E05B 37/0024

(56) References Cited

U.S. PATENT DOCUMENTS

| | | | | |
|---|---|---|---|---|
| 2018/0061163 | A1* | 3/2018 | Ku | E05B 9/02 |
| 2018/0073275 | A1* | 3/2018 | Ullrich | E05B 17/0066 |
| 2018/0171666 | A1* | 6/2018 | Tien | E05B 55/005 |
| 2018/0171672 | A1* | 6/2018 | Lin | E05B 47/0657 |
| 2018/0238081 | A1* | 8/2018 | Monaghan | E05B 9/084 |
| 2018/0291647 | A1* | 10/2018 | Uka | E05B 9/002 |
| 2018/0291650 | A1* | 10/2018 | Zabala Zabaleta | G07C 9/00571 |
| 2018/0298641 | A1* | 10/2018 | Rasmussen | E05B 47/0012 |
| 2019/0073848 | A1* | 3/2019 | Denison | E05B 37/00 |

FOREIGN PATENT DOCUMENTS

| | | | |
|---|---|---|---|
| GB | 2200680 | A | 8/1988 |
| JP | 2002168011 | A | 6/2002 |
| JP | 2012233337 | A | 11/2012 |

* cited by examiner

LOCK WITH IMPROVED LOCKING SYSTEM

CROSS-REFERENCE TO RELATED APPLICATIONS

This application is the United States national phase of International Application No. PCT/ES2015/070689 filed Sep. 23, 2015, and claims priority to Spanish Patent Application No. P201431410 filed Sep. 26, 2014, the disclosures of which are hereby incorporated in their entirety by reference.

BACKGROUND OF THE INVENTION

Field of the Invention

The present invention relates to a lock with an improved locking system, the lock being of the kind used in lockers and/or cabinets with the advantage that it adapts to a door of any thickness by means of its configuration and specific design. It is to be applied in the locksmithing industry.

Description of Related Art

One type of lock usually used in lockers is made up of two pieces: a lock block, where the lock mechanism is found, and a support element of the lock block.

This type of lock is installed in a gap made in a door, such that the lock block is placed in said gap and the support element is screwed to the lock block gripping the door between the lock block and the support element.

This fastening system has a chronic problem derived from the different thicknesses of the doors that the lock must be fitted to since the thickness of the cited door does not always coincide with the thickness of the lock block that is desired to be installed.

The difference in thicknesses between the lock block and the door makes it so that if the door is less thick, when the lock and the support element are screwed in it creates a clearance between them that makes it so the lock does not stay firmly fastened in the door.

In order to solve this clearance problem some fitting screws are installed that exert pressure against the inside portion of the door, in this way holding the lock block and preventing the problem of the clearance in the lock.

The fitting screw system has various problems, one of them being that as the screws exert pressure against the inside of the door, said inside of the door can be damaged by the action of the screw. In order to prevent this problem the assembly of the fitting screws must be done carefully, which prevents the use of automatic machinery, furthermore, depending on the material that the door is made from, the placement of the fitting screws exerting pressure on the door can cause damage in the door. Finally, the fastening that the fitting screw system offers is not a firm fastening, meaning that the locks usually end up moving and on occasion even come off the door.

An additional problem that the fitting screw system has is that the fitting screws have a long length in order to cover multiple thicknesses of doors, therefore once these fitting screws have been installed they project from the support, forming an uncomfortable element that projects from the door on the inside thereof and causes inconveniences in the use of the locker where the lock is installed. This problem forces the installers to bring different sized screws, in this way reducing part of the length of the screw that projects out, but with this solution the problem is not prevented in its entirety; the only way of preventing the problem in its entirety is cutting the screws to the exact size needed in each case, which is equally impractical, given that cutting a screw usually generates sharp surfaces.

Additionally, due to the pressure that the fitting screws exert on the support together with the clearance between the support and lock block, it can occasionally cause the support to bend.

In summary, the current locking system of this kind of locks has aesthetic problems (screws projecting out, damage to the inside surface of the door, bent support), assembly problems (due to the adjustment of the length of the screws) and reliability problems (due to the type of locking via pressure of the fitting screws).

SUMMARY OF THE INVENTION

The invention that is described discloses a lock with an improved locking system comprising a lock block, a support and at least two fastening screws that fasten the lock block to the support with a door located between the lock block and the support, and also comprising grub screws screwed into the support that project a certain length from of the support depending on a portion of the grub screw screwed into the support. The length of the grub screws that projects from the support together with the thickness of at least one chock match an existing clearance between the door and the support.

The lock with an improved locking system comprises at least one chock of a certain thickness that is situated between the lock block and the support, such that the thickness of at least one chock matches the existing clearance between the door and the support.

The thickness of the two chocks that are used in the lock object of the invention has several values for, by combining chocks of different thickness values, matching the cited clearance, and if it is not possible to match the clearance by combining chocks of different thickness values, by using the grub screws.

There are two embodiments of the support for the lock with an improved locking system object of the invention, the two embodiments of the support object of the invention comprise a rectangular body, an interior rectangular structure configured by four perimeter walls that project from the rectangular body, a series of perimeter holes in the rectangular body and at least two holes in at least two corners of the interior rectangular structure, where the grub screws are located in the perimeter holes comprised by the support.

The second embodiment of the support, apart from all the elements listed in the previous paragraph, comprises protrusions in the corners of the rectangular body that project perpendicularly from the rectangular body, and that have a U shape such that between the U-shaped protrusions housings are created.

The chock of the lock with an improved locking system comprises a hollow rectangular structure that comprises internal tabs, such that the mentioned internal tabs, in the first embodiment as well as in the second embodiment of the support, butt up against the perimeter walls of the interior rectangular structure, and furthermore in the second embodiment of the support they are situated corresponding with the housings between the protrusions of the support.

BRIEF DESCRIPTION OF THE DRAWINGS

To complete the description, and for the purpose of helping to make the characteristics of the invention more readily understandable, the present specification is accompanied by a set of figures constituting an integral part of the same, which by way of illustration and not limitation represent the following.

Figure 1:
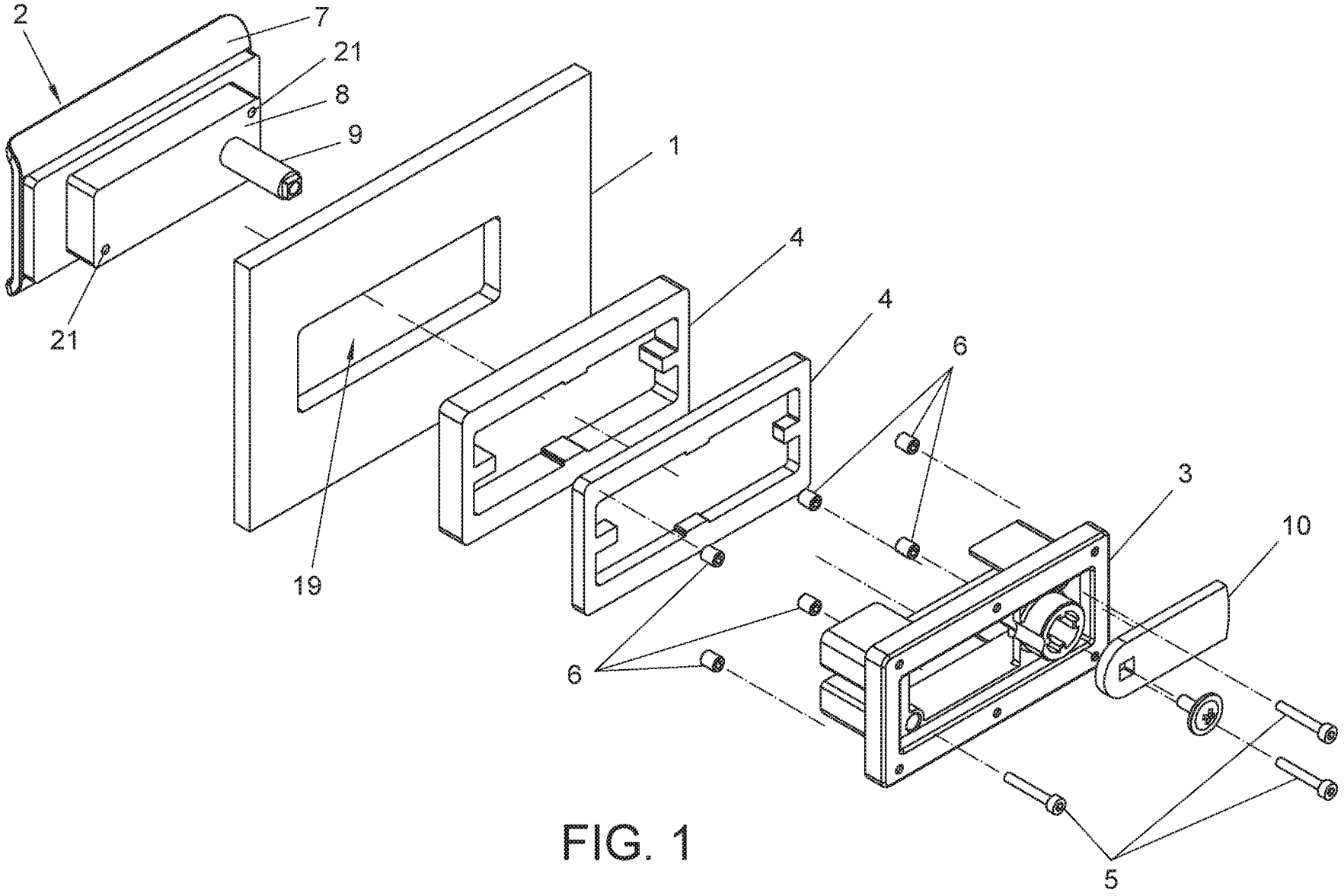
FIG. 1 is an exploded perspective view of the lock object of the invention.
Figure 2:
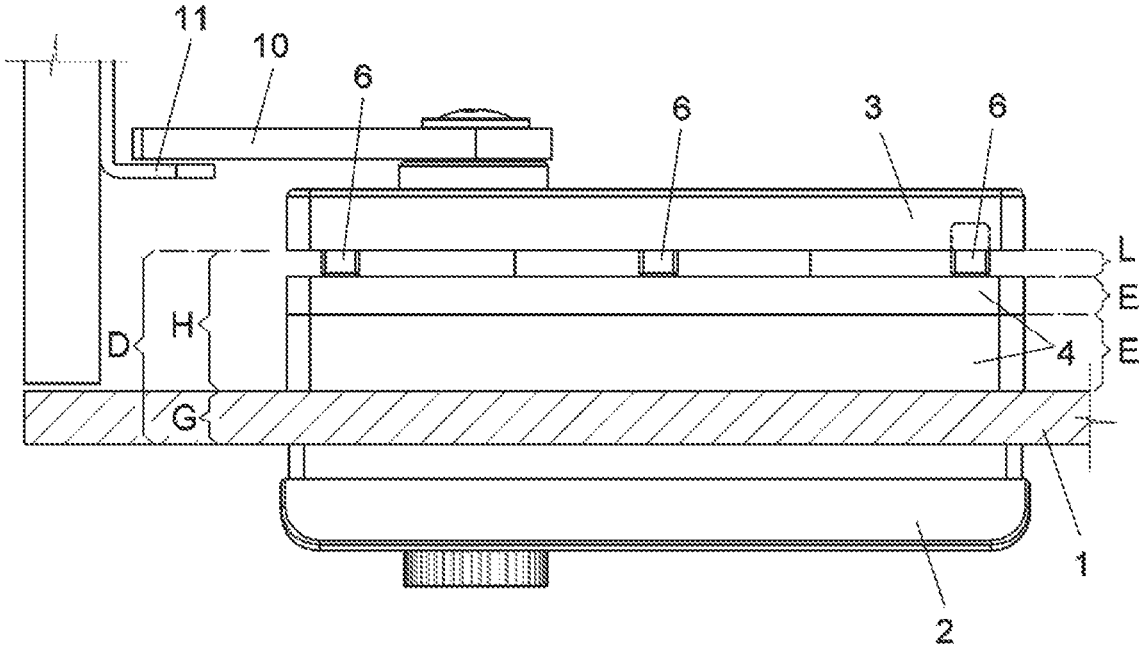
FIG. 2 is a lateral view of the lock object of the invention.
Figure 3:
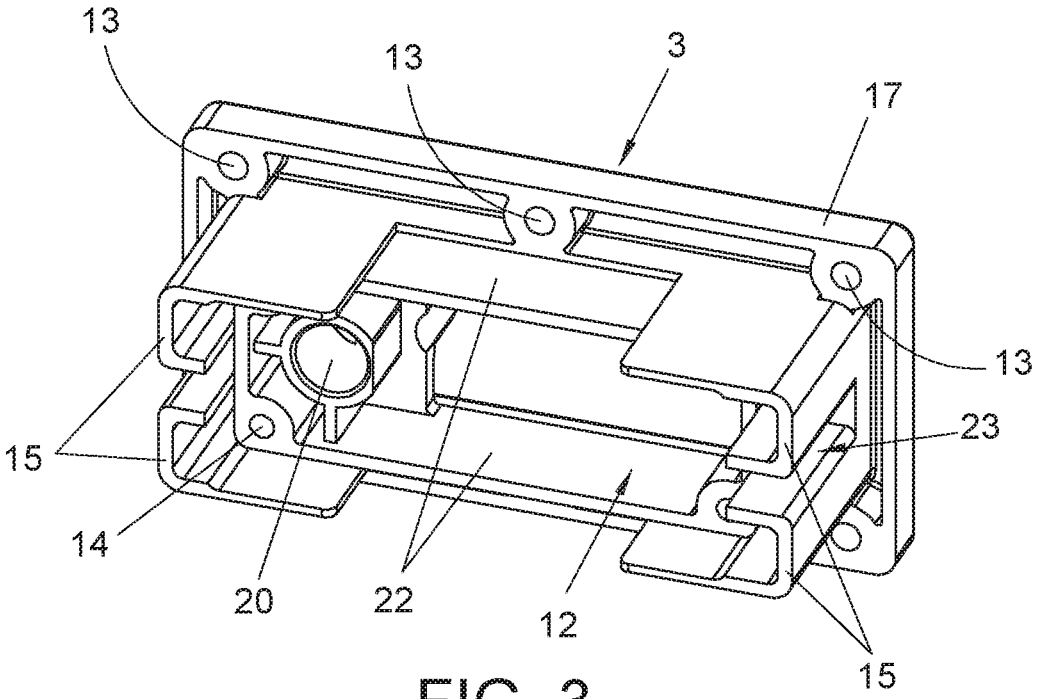
FIG. 3 is a perspective view of a support of the lock object of the invention.
Figure 4:
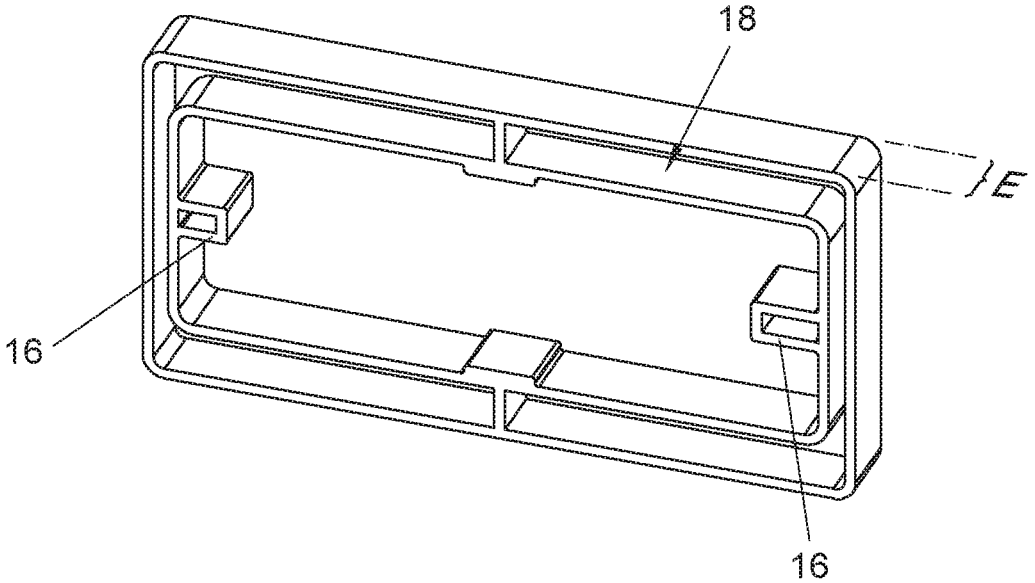
FIG. 4 is a perspective view of a chock of the lock object of the invention.

The various numerical references found in the figures correspond to the following elements:

1.—door,
2.—lock block,
3.—support,
4.—chock,
5.—fastening screws,
6.—grub screws,
7.—main body,
8.—booth,
9.—shaft,
10.—platen,
11.—block,
12.—interior rectangular structure,
13.—perimeter holes,
14.—holes,
15.—protrusions,
16.—internal tabs,
17.—rectangular body,
18.—hollow rectangular structure,
19.—rectangular gap,
20.—guide gap,
21.—threaded housing,
22.—wall,
23.—housing,
D.—distance,
E.—thickness,
G.—depth,
H.—clearance, and
L.—length.

DESCRIPTION OF THE INVENTION

The object of the invention is a locker and/or cabinet lock that has an improved locking system, such that through the elements of its door (1) locking system it solves the problems mentioned in the background of the invention.

For the placement of the lock object of the invention, the door (1) has a rectangular gap (19) wherein the cited lock is placed.

The lock object of the invention comprises:

a lock block (2),
a support (3),
grub screws (6),
three fastening screws (5).

The lock block (2) comprises a main body (7) from which a rectangular-shaped booth (8) projects out where the mechanisms for moving a shaft (9) associated with a platen (10) are incorporated, such that the shaft (9) comes out perpendicularly from the booth (8). Likewise the booth (8) comprises three threaded housings (21) to screw the fastening screws (5) into.

With the door (1) closed, a rotation of the shaft (9) makes it come into contact with the platen (10) with a block (11) situated in the gap of the locker and/or cabinet that closes the mentioned door (1), through this contact preventing the door (1) from being opened.

The support (3) of the lock object of the invention comprises:

a rectangular body (17),
an interior rectangular structure (12) configured by four perimeter walls (22) that project from the rectangular body (17),
a series of perimeter holes (13) in the rectangular body (17), and
three holes (14) in three corners of the interior rectangular structure (12).

On one side the interior rectangular structure (12) comprises a guide gap (20) for the guided path of the shaft (9) of the lock block (2) through the support (3).

The lock block (2) is introduced through the rectangular gap (19) of the door (1) and the lock block (2) is fastened to the support (3) via three fastening screws (5) that are screwed into the threaded housings (21) of the booth (8), such that the booth (8) is made to face the walls (22) of the interior rectangular structure (12).

The support (3) of the lock object of the invention, in a second embodiment, comprises protrusions (15) in the corners of the rectangular body (17), said protrusions (15) being U-shaped, with housings (23) between the protrusions (15). This second embodiment of the support (3) is used for doors (1) in which the rectangular gap (19) wherein the lock object of the invention is placed is longer.

The support (3) in the embodiment that includes the protrusions (15) adapts the lock to doors (1) with larger rectangular gaps (19) than the support (3) without protrusions (15), such that the lock object of the invention adapts to different sizes of rectangular gaps (19) in the doors (1) of the lockers.

In the lock object of the invention, when the lock block (2) is attached to the support (3) through the fastening screws (5), between the lock block (2) and the support (3) there is a distance (D), and likewise the door (1) in which the lock object of the invention is placed has a depth (G), said depth (G) usually being smaller than the distance (D) between the lock block (2) and the support (3), such that a clearance (H) is created which is the same as the distance (D) between the lock block (2) and the support (3), reducing the clearance (H) due to the depth (G) of the door (1).

In order to match said clearance (H), the lock object of the invention comprises grub screws (6), said grub screws (6) being screwed into the perimeter holes (13) of the support (3), such that as said grub screws (6) are screwed more or less into the perimeter holes (13) a greater or lesser length (L) projects out.

If through the grub screws (6) it is not possible to match the clearance (H) in its entirety, at least one chock (4) is used, which is placed between the lock block (2) and the support (3).

There are different embodiments of chocks (4) that are differentiated from each other because they have different thicknesses (E); thus, in order to match the aforementioned clearance (H), chocks (4) of different thicknesses (E) are combined.

Thus, in order to match the clearance (H) in its entirety, it is possible to combine chocks (4) of different thicknesses and grub screws (6) with adjustable lengths (L).

The chocks (4) of the lock object of the invention comprise a hollow rectangular structure (18) that comprises internal tabs (16) that make possible the placement of the chocks (4) whether the support (3) has the protrusions (15) or does not have said protrusions (15).

In the first embodiment of the support (3), in which it does not comprise protrusions (15), the internal tabs (16) of the chocks (4) butt up against the perimeter walls (22) of the interior rectangular structure (12) of the support (3).

In the second embodiment of the support (3), the one which does comprise the protrusions (15), the chocks (4) are situated around the protrusions (15) of the support (3) and the internal tabs (16) of the chocks (4) butt up against the perimeter walls (22) of the interior rectangular structure (12), said internal tabs (16) becoming fastened in the housings (23) generated between the U-shaped protrusions (15).

The grub screws (6) are held in the chocks (4), whereby this configuration does not damage the door (1) since the pressure is spread out uniformly with the surface of the chock (4).

In other words, in the lock, in order to match the clearance (H), first the grub screws (6) are used and, if through said grub screws (6) it is not possible to match the clearance (H) exactly, chocks (4) of different thicknesses (E) are used. The lock assembly object of the invention, using the grub screws (6) and if necessary, combining chocks (4), facilitates the assembly process for the worker.

In the lock in which grub screws (6) are used together with the chocks (4), said grub screws (6) do not project out of the support (3), whereby the unsightly effect that was produced by the locks known in the state of the art is avoided.

With the configuration explained here, the contact of the support (3) with the door (1) is made through the chocks (4), whereby the door (1) is not damaged as occurs with the adjustment system known until now.

In the lock object of the invention, the chocks (4) keep their integral structure since the fastening screws (5) that join the lock block (2) and the support (3) do not have any interaction with the cited chocks (4).

Since the stress is on the perimeter, and due to the depth of the support (3), the latter does not bend as in other supports in the state of the art that are no more than sheets.

The stress generated in the grub screws (6), with the lock object of the invention, is distributed:

on one side of each grub screw (6), as the grub screws (6) exert load on the chocks (4) the point load transforms into a surface load, in other words, the load that the chock (4) puts on the door (1) is uniform because of the contact surface between the chock (4) and the door (1), and on the other side of each grub screw (6), the stress generated on the support (3) upon fastening the lock block (2) to the support (3) is distributed uniformly over the cited support (3) by screwing the grub screws (6) into the perimeter holes (13), without generating localized stress in one point as was the case in the systems used until now, such that a more solid and safe fastening is achieved than with the cited systems used until now.

The invention must not be seen as limited to the particular embodiment described in this document. Those skilled in the art may develop other embodiments in light of the description made herein. As such, the scope of the invention is defined by the following claims.

The invention claimed is:

1. A lock with an improved locking system comprising a lock block, a support, at least two fastening screws that fasten the lock block to the support with a door located between the lock block and the support, such that a rotation of a shaft comprised within the lock block and fixed to a platen causes the platen to come into contact with a block positioned at a distance from the door to restrict the door from being opened, wherein the lock comprises a plurality of grub screws screwed into the support that project a length from the support, the length depending on a portion of the grub screw screwed into the support, wherein the length matches a clearance existing between the door and the support, the clearance depending on a depth of the door so that the lock fastens doors with a variety of depths.

2. The lock with an improved locking system according to claim 1, wherein if at least one chock of a thickness is located between the lock block and the support, the thickness of at least one chock together with the length of the grub screws matches the clearance existing between the door and the support.

3. The lock with an improved locking system according to claim 1, wherein the support comprises:

a rectangular body, an interior rectangular structure configured by four perimeter walls that project out of the rectangular body, a series of perimeter holes in the rectangular body, and at least two holes in at least two corners of the interior rectangular structure, wherein the grub screws are located in the perimeter holes of the rectangular body.

4. The lock with an improved locking system according to claim 2, wherein the at least one chock comprises a hollow rectangular structure.

5. The lock with an improved locking system according to claim 4, wherein the hollow rectangular structure of the at least one chock comprises internal tabs.

6. The lock with an improved locking system according to claim 5, wherein the internal tabs of the hollow rectangular structure butt up against the perimeter walls of the interior rectangular structure.

7. The lock with an improved locking system according to claim 3, wherein the interior rectangular structure comprises on one side a guide gap for the guided path of a shaft of the lock block through the support.

8. The lock with an improved locking system according to claim 3, wherein the support comprises protrusions in the corners of the rectangular body that project perpendicularly to the rectangular body.

9. The lock with an improved locking system according to claim 8, wherein the protrusions of the support are U-shaped with housings between the U-shaped protrusions.

10. The lock with an improved locking system according to claim 9, wherein the hollow rectangular structure of the at least one chock comprises internal tabs, and wherein the internal tabs of the hollow rectangular structure butt up against the perimeter walls of the interior rectangular structure and are situated corresponding to the housings between the protrusions of the support.

11. The lock with an improved locking system according to claim 2, further comprising a plurality of chocks with thicknesses of different values.

* * * * *